US006112854A

United States Patent [19]

Davis

[11] Patent Number: 6,112,854

[45] Date of Patent: Sep. 5, 2000

[54] TOE BOARD FOR SCAFFOLDING

[75] Inventor: Jeffrey D. Davis, Winnie, Tex.

[73] Assignee: Brand Scaffold Services, Inc., Chesterfield, Mo.

[21] Appl. No.: 09/265,169

[22] Filed: Mar. 9, 1999

[51] Int. Cl.[7] ..... A47L 3/02; E04G 1/16; E04G 5/00; A47F 1/10

[52] U.S. Cl. ..... 182/113; 248/295.11

[58] Field of Search ..... 182/113; 248/295.11, 248/346.07, 228.1

[56] References Cited

U.S. PATENT DOCUMENTS

| | | |
|---|---|---|
| 852,172 | 4/1907 | Eschholz et al. . |
| 2,289,844 | 7/1942 | Lamb . |
| 2,332,477 | 10/1943 | Thornley . |
| 3,480,257 | 11/1969 | Bourn et al. . |
| 3,782,499 | 1/1974 | Fisher . |
| 3,785,602 | 1/1974 | Juculano . |
| 3,848,854 | 11/1974 | De Barbieri . |
| 3,853,203 | 12/1974 | Werner et al. . |
| 3,863,899 | 2/1975 | Werner . |
| 4,236,698 | 12/1980 | Compte . |
| 5,269,394 | 12/1993 | Haroldson, Sr. . |

*Primary Examiner*—Daniel P. Stodola
*Assistant Examiner*—Hugh B. Thompson
*Attorney, Agent, or Firm*—Senniger, Powers, Leavitt & Roedel

[57] ABSTRACT

A toe board is provided which can be adjusted in length for use with varying size scaffolds. The toe board further includes sides flanges for removably securing the toe board to planking of a scaffold by direct securement to the planking with removable fasteners.

12 Claims, 3 Drawing Sheets

TOE BOARD FOR SCAFFOLDING

BACKGROUND OF THE INVENTION

Working on scaffolding has become commonplace when building or maintaining buildings. The scaffolding can be relatively close to the ground or can be at elevated positions of several stories. Workers' safety is of utmost importance, as is the safety of other people on or adjacent the scaffolding, as for example, pedestrians passing by a building being renovated. To improve the safety of the use of scaffolds, both hand rails and toe boards are provided. Toe boards are used to prevent workers from accidentally overstepping the edge of the scaffold and to prevent tools or other items from falling off the scaffold floor or decking.

Scaffolds are normally built of a pipe superstructure providing columns for vertical support and beams for horizontal supports. Decking is then laid on the beams with the decking many times taking the form of loose boards, for example, 2×10s or 2×12s. It is important to maintain these boards on the support in a manner to prevent them from being dislodged and falling below, and to keep them from shifting relative to one another and forming gaps through which objects can drop.

Many forms of toe boards have been known in the industry but have generally involved complicated securement structures to removably secure the toe boards to the scaffolding. Many have provided complicated and expensive structures for the securement of the toe board to the scaffolding and many have lacked the ability to be able to custom-fit the toe board to varying lengths and widths of scaffolds. Because the scaffolding is many times at a highly elevated position, the ability to easily secure the toe boards to the structure without endangering the worker is important. A common type of toe board that is simple in structure is a board that is cut to length at the work sight and then toe nailed in place. Such a toe board requires a significant amount of time to make and secure and is difficult to secure when elevated because of the difficulty in accessing both sides for toe nailing.

SUMMARY OF THE INVENTION

The present invention provides a simple to use and inexpensive to manufacture toe board. The toe board is adaptable for use on varying sizes of scaffolds and can be easily secured to the decking in a removable manner such that the toe board can be reused on subsequent projects.

The present invention eliminates the need for custom-making toe boards on the job site and thereby reduces the amount of labor necessary for installing them.

Another object of the present invention is to provide a toe board which can be easily secured to the deck of the scaffold and also easily removed therefrom.

A still further object of the present invention is to provide a toe board which can be used to secure the deck planks of the scaffold in fixed relation to one another to prevent relative movement therebetween.

In general, a toe board of the present invention comprises first and second planks each having a flange projecting laterally outwardly from outer positioned surfaces for securing the planks to the scaffold. The toe board includes retaining means operable to allow relative longitudinal movement of the planks such that the toe board is adjustable in length.

In a second aspect of the present invention, a toe board is provided that includes a plank having a laterally projecting flange along at least a portion of the length thereof with the flange having a plurality of apertures for receiving fasteners to removably fasten the toe board to a scaffold in a fixed upright position.

In a third aspect of the present invention, a scaffold is provided that has a deck and a toe board secured to the deck. The toe board has an upstanding member with oppositely facing flanges overlying portions of the deck with fasteners extending thru the flanges to secure the toe board to the deck.

Other objects and features of the present invention will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENTS

Figure 1:
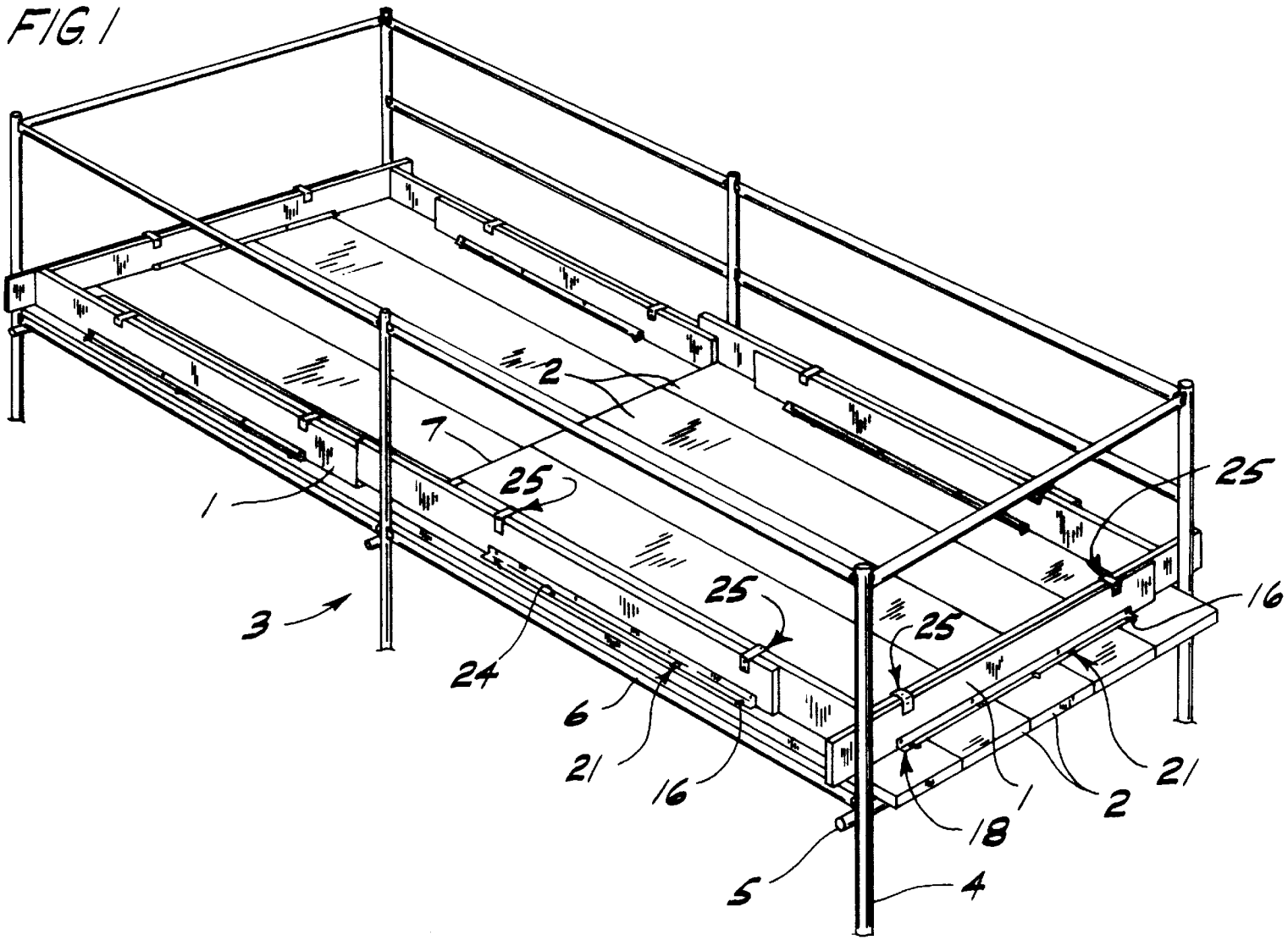
FIG. 1 is a perspective view of toe boards of the present invention mounted on a scaffold.

Referring now to the drawings, a toe board of the present invention is generally designated by the numeral 1. As shown in FIG. 1, the toe board is extensible longitudinally and can be removably mounted on the floor or deck 2 of a scaffold 3. The scaffold 3 can be comprised of vertical supports 4 which are connected to transverse horizontal supports 5 and longitudinal horizontal supports 6. Such scaffolding is well-known in the art.

The deck 2 comprises a plurality of planks that rest on the transverse horizontal supports 5 and extend longitudinally along the scaffolding in side-by-side relation forming a work area. Typically the planks are 2×10s or 2×12s having a length of 8 to 12 feet. At adjacent sections of the scaffolding, the plank ends overlap one another forming a step 7.

Figure 2:
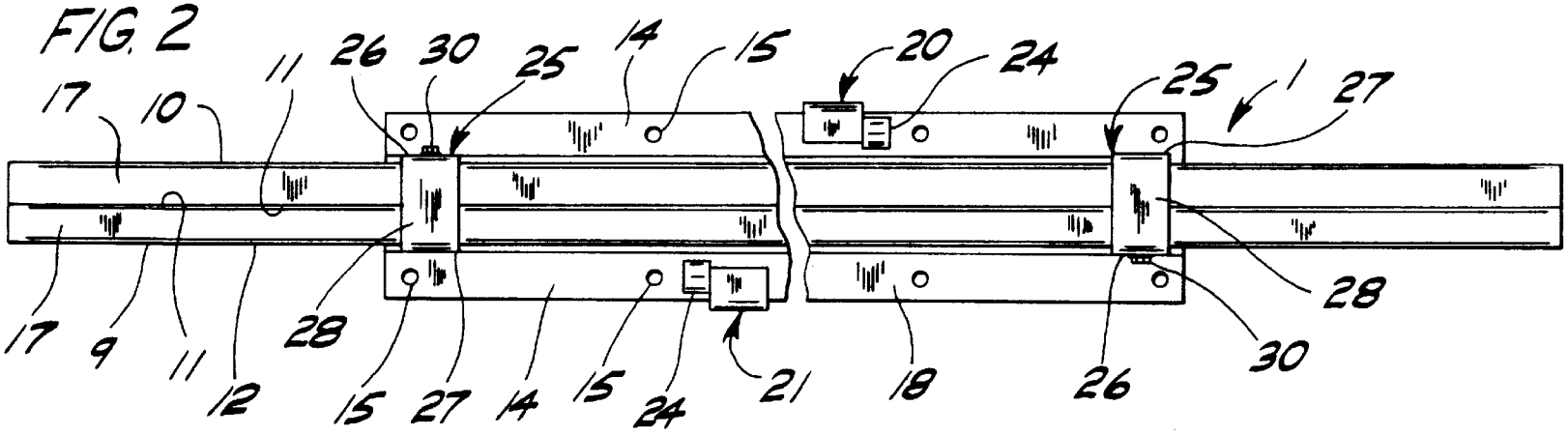
FIG. 2 is a fragmentary top view of a toe board.
Figure 3:
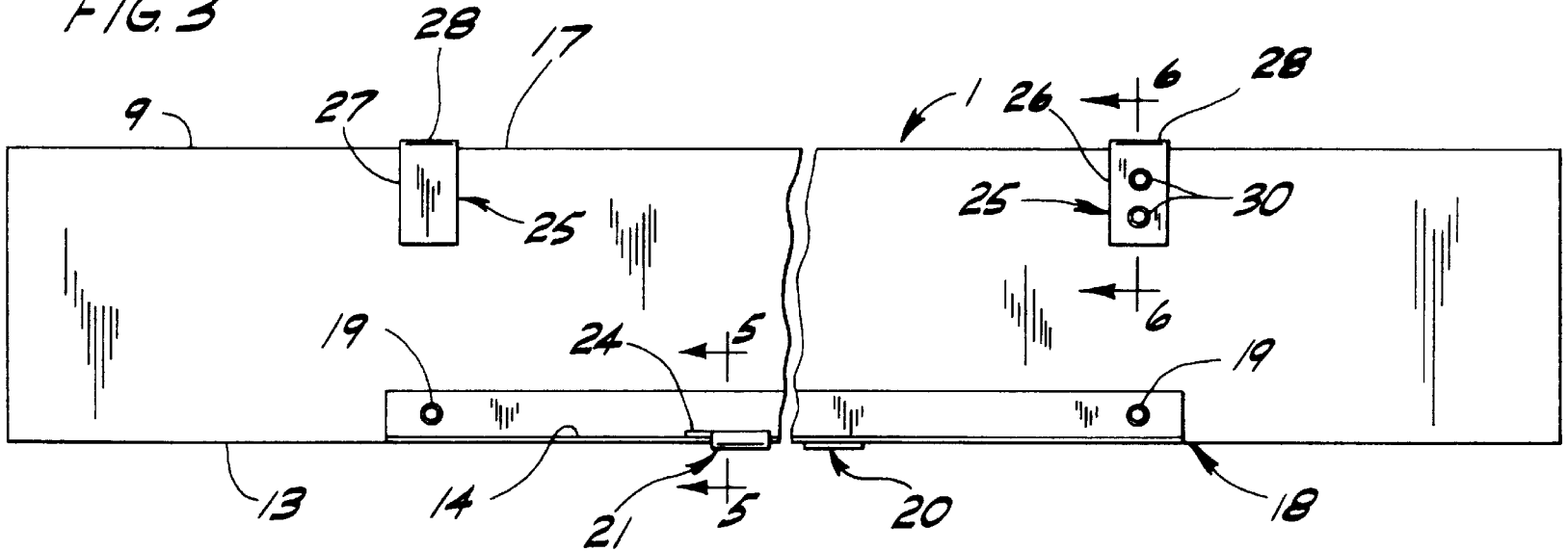
FIG. 3 is a fragmentary side elevation view of a toe board as seen in FIG. 2.

In accordance with one aspect of this invention, the toe board is longitudinally extensible prior to securement to the planks of the deck 2 to allow for custom fitting of the toe board to the scaffold. As seen in FIGS. 2 and 3, the toe board 1 includes two planks 9 and 10, each of a generally rectangularly cross section and having opposite relatively wide surfaces 11 and 12 and narrower top and bottom edges 17 and 13 respectively. The side surface 11 of plank 9 faces the side surface 11 of plank 10 and is slidably engaged therewith. The surfaces 12 face oppositely and outwardly from the toe board 1. A flange member 14 projects laterally outwardly from each surface 12 adjacent the bottom edge 13 and runs along a substantial length of the respective plank 9 or 10. The flange 14 can be an integral part of each plank 9, 10 or can be separate as shown in the figures. Spaced along the length of the flange 14 is a plurality of vertical apertures 15, adapted for receiving fasteners 16 therethrough.

The planks 9 and 10 can be made from any suitable material. In a preferred embodiment, the planks 9 and 10 are wood, as for example, 1×6s, and the flanges 14 are separate parts secured to respective planks 9, 10. As seen in FIGS. 3 and 5, each flange 14 is part of an angle member 18 which is shown as a right angle structural member which can be, for example, a 1 inch×1 inch angle of galvanized metal. The angles 18 are secured to opposite side surfaces 12 of the toe board 1 by suitable fasteners such as wood screws 19. Each angle 18 is preferably shorter than the length of the plank 9 or 10 to which it is fastened. It has been found that the angles 18 should have their ends spaced approximately 4 to 8 inches from respective ends of the respective planks 9, 10.

Figure 4:
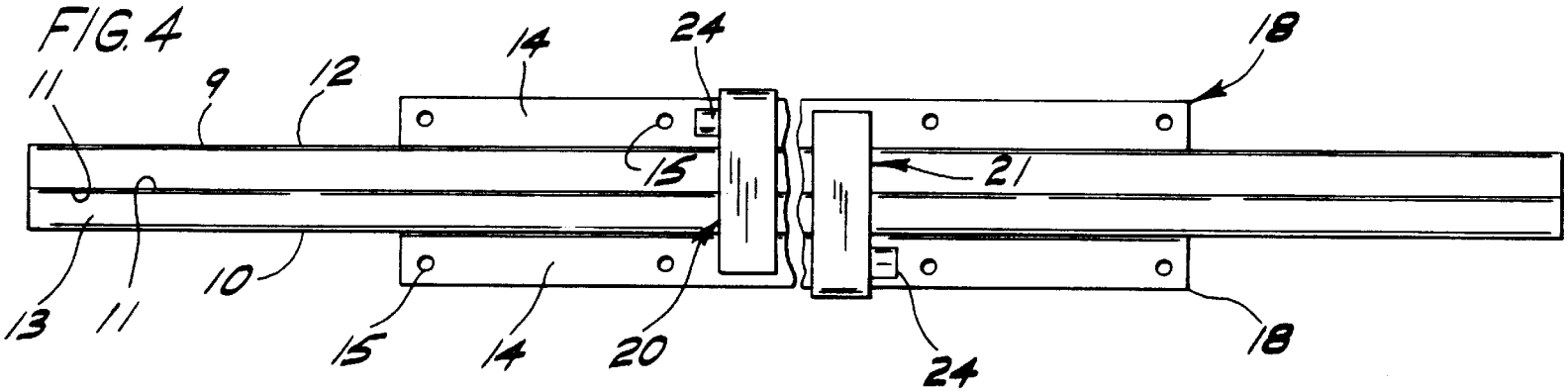
FIG. 4 is a fragmentary bottom view of the toe board as seen in FIG. 2.
Figure 5:
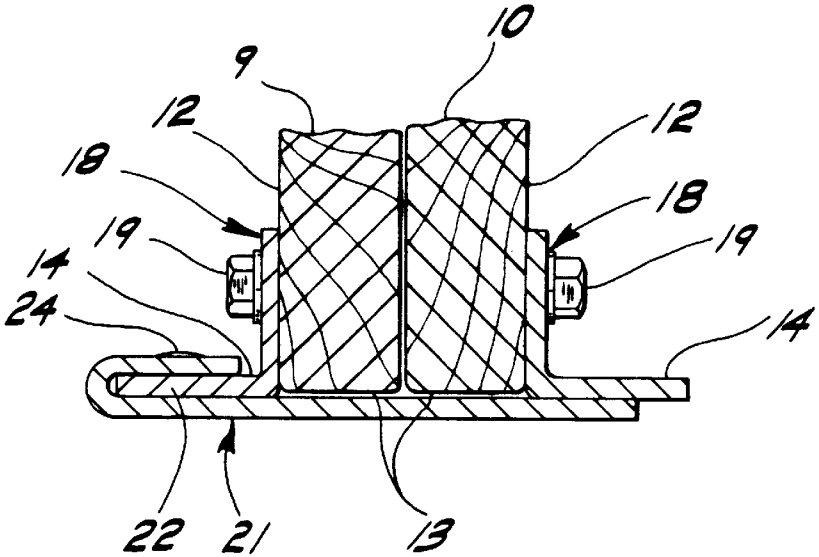
FIG. 5 is a fragmentary sectional view of a toe board taken along the line 5—5 in FIG. 3.

Retainer means is provided to retain the planks 9 and 10 of the toe board 1 in longitudinal sliding relation and to prevent their separation as an extensible toe board. This retaining permits easy length adjustment of the toe board 1. As best seen in FIGS. 4 and 5, the retaining means includes J-shaped retainers such as a first slide or clip 20 fixedly secured to one of the angles 18, and not to the opposite plank or angle, adjacent one end of the toe board 1 and a second slide or clip 21 secured to the other angle 18, and not to the opposite plank or angle, adjacent the opposite end of the toe board 1. As seen in FIG. 5, each clip 20, 21 has a base portion 20*a*, 21*a* which is secured, e.g., welded, to the horizontal flange 14 of a respective angle. The base portion 20*a*, 21*a* under the bottom edges 13 of the planks 9 and 10 and across the width of toe board 1 and has a channel forming portion 20*b*, 21*b* respectively, which defines a groove or channel 22 which slidably receives the flange 14 of the other angle therein. Because each angle 18 has a clip 21 secured thereto which slidably engages the flange 14 of the other angle 18, a simple means is provided for allowing longitudinal movement of the planks 9 and 10 relative to one another while preventing transverse motion of the planks 9, 10 relative to one another. As best seen in FIG. 2, a stop 24 is attached to or part of the flange 14 of one of the angles 18. The stop 24 can be an upset protuberance extending upwardly from the upper surface of the flange 14. The stop 24 is adapted to engage one of the clips 21 to limit movement of the planks 9 and 10 relative to one another in the toe board shortening direction and the clips 20 and 21 limit longitudinal relative movement of the planks 9 and 10 by engaging one another in the lengthening direction of the toe board 1 thereby preventing accidental separation of the planks 9 and 10.

Figure 6:
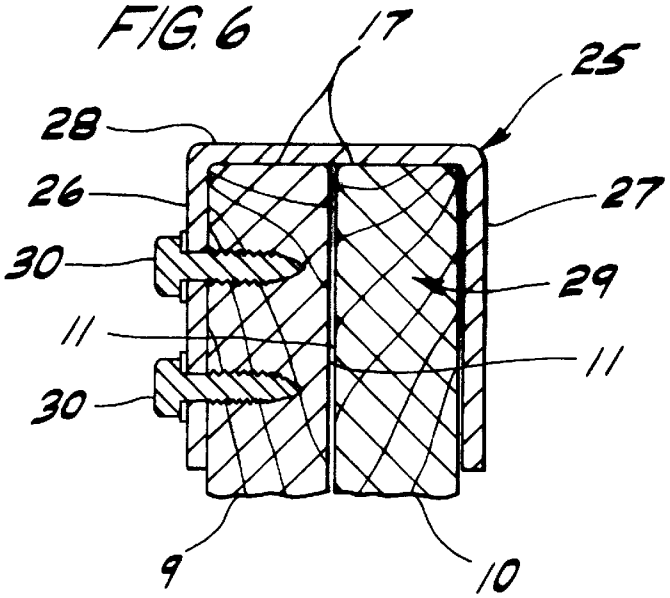
FIG. 6 is a fragmentary sectional view of a toe board taken along the line 6—6 in FIG. 3.

The means for retaining the toe boards in sliding face-to-face relationship also includes a pair of channel or U-shaped retainers such as slide channels or brackets, each indicated generally at 25, each fixedly secured to a respective plank 9, 10 and not the other plank. As best seen in FIG. 6, the slide channels 25 are generally U-shaped, each having legs 26 and 27 connected by a bight portion 28. The legs 26 and 27 and the bight 28 form a channel 29 for receiving upper portions of the planks 9 and 10 therein. As seen in FIG. 2, the slides 25 are each secured to an outer surface 12 of a respective plank 9, 10 adjacent opposite ends of the toe board 1. The slide 25 secured to the plank 9 is positioned adjacent the same end of the plank 9 as the respective clip 21 secured to the plank 9. Likewise, the slide 25 secured to the plank 10 is positioned adjacent the same end that the clip 21 is secured to the plank 10. Securement of the slides 25 to the respective plank 9 or 10 can be by any suitable means such as fasteners 30, for example, wood screws. Preferably, in the fully extended position, there are about 18–36 inches of overlap of the planks 9 and 10.

To secure the toe board 1 to the deck 2 to form a scaffold structure, the toe board 1 is adjusted to the appropriate length. Fasteners 16, as seen in FIG. 1, are then driven through appropriate apertures 15 in flanges 14 and into the deck 2. Nails, screws or other suitable fasteners can be used for securing and also allow easy removal of the toe board for re-use. Because the flanges 14 project outwardly from opposite sides of the toe board 1, transverse motion of the top of the toe board 1 is limited thereby preventing accidental tipping of the toe board 1 in both transverse directions.

The height of the toe board 1 is selected such that when toe boards are attached to the deck 2 adjacent steps 7, the height is adequate at this transition point to prevent tools or the like from being kicked off or falling off from the deck 2. It has been found that an approximate 6 inch tall toe board will achieve this purpose.

Even though the clips 21 project downwardly from the bottom edges of the planks 9 and 10, this is not a problem with the use of the toe board 1. Any length of toe board 1 can be utilized in the present invention. However, it has been found that toe boards having extended lengths of between about 4 feet and about 12 feet are preferred for ease of handling by workers.

By positioning a toe board 1 transversely across a plurality of planks in the deck 2 and securing the toe board thereto, the planks are prevented from independent longitudinal movement or transverse movement with respect to the scaffold 3. When the project is completed, the toe boards 1 can be easily removed from the scaffold 3 by removing the fasteners 16, allowing the toe boards to be reused. By being extensible in length, the toe boards 1 can be easily adjusted for any size scaffold making them versatile in use.

The toe board can also be constructed using one plank 9 or 10. In this form, the plank would have at least one flange 14 projecting laterally outwardly therefrom or preferably could have a flange 14 projecting from each of the opposite sides of the plank adjacent the bottom edge thereof. The structure of the flange(s) 14 can be similar to the structure of the flanges 14 described above, preferably being part of an angle member 18. The flange(s) 14 can be secured to a toe board plank and the scaffold also as described above.

It is to be understood that the angle 18 can be in multiple sections along the length of the planks 9, 10 if desired.

As various changes could be made in the above constructions without departing from the scope of the invention, it is intended that all matter contained in the above description or shown in the accompanying drawings shall be interpreted as illustrative and not in a limiting sense.

What is claimed is:

1. An adjustable length toe board for use on scaffolding, said toe board comprising:

first and second planks positioned beside one another in side by side generally parallel relationship with each plank having a generally rectangular cross section with bottom and top edges and first and second side surfaces, said first side surface of the first plank facing the first side surface of the second plank and the second side surfaces facing oppositely;

a flange projecting laterally outwardly from the second side surface of each plank and extending along a substantial portion of the length of the plank and being positioned adjacent the bottom edge of the plank, said flanges having apertures therethrough, each aperture having a generally vertical axis for receiving a generally vertically oriented fastener; and retaining means operatively connected to the planks for allowing relative longitudinal movement of the planks while retaining the planks in side by side relationship to form a unitary toe board structure.

2. The toe board as set forth in claim 1 wherein said retaining means includes first and second channel shaped retainers each comprising a bight portion overlying said top edges of the first and second planks and first and second legs extending down from the bight portion on said second side surfaces of the first and second planks, respectively, said first leg of one said retainer being fixedly secured to the first plank and the first leg of the other retainer being secured to the second plank and said second legs of both retainers being free of fixed connection to the first and second planks to permit the first plank to be slidably moved relative to the second plank.

3. The toe board as set forth in claim 2 wherein said retaining means further includes a third retainer having a base portion underlying the bottom edges of the first and second planks and fixedly secured to the flange on the second plank and a channel-forming portion defining a channel slidably receiving the flange on the first plank, and a fourth retainer having a base portion underlying the bottom edges of the first and second planks and fixedly secured to the flange on the first plank and a channel-forming portion defining a channel slidably receiving the flange on the second plank, said third and fourth retainers cooperating to permit longitudinal movement of the planks relative to one another, retaining the planks against substantial transverse movement relative to one another, and retaining the planks against longitudinal separation.

4. The toe board as set forth in claim 3 wherein each said flange is formed by an angle member secured to a respective plank, and wherein each flange has a plurality of vertical apertures therein along the length thereof.

5. The toe board as set forth in claim 4, said toe board including a stop positioned on one of said flanges which selectively engages one of the third and fourth retainers and limits relative longitudinal movement of the first and second planks in one direction.

6. The toe board as set forth in claim 5 wherein the third and fourth retainers have portions positioned for engagement with one another when the first and second planks are moved longitudinally relative to one another thereby to limit the extension of the toe board.

7. A scaffold having at least one toe board, said scaffold including:

a superstructure formed by a plurality of generally vertical support members and a plurality of generally horizontal support members connected thereto;

a plurality of deck planks supported by the superstructure to form a deck;

a toe board extending generally perpendicular to the deck planks, said toe board having oppositely facing flanges extending along a substantial portion of the length thereof and positioned adjacent a bottom edge of the toe board and overlying a portion of said deck, said flanges extending laterally outwardly from opposite side faces of the toe board, said flanges having apertures there through, each aperture having a generally vertical axis;

fasteners extending generally vertically through the apertures and removably securing the toe board to the deck; and said toe board comprising first and second clongate upstanding members positioned beside one another.

8. A scaffold as set forth in claim 7 wherein the fasteners fasten the first and second upstanding members in fixed upstanding positions on the deck.

9. A scaffold as set forth in claim 8 wherein said flanges are formed by angle members secured to the toe board.

10. A scaffold as set forth in claim 8 wherein said first and second upstanding members being movably mounted to one another.

11. A scaffold as set forth in claim 10 wherein said first and second upstanding members are retained against separation thereby to form a unitary structure.

12. A scaffold as set forth in claim 11 wherein said scaffold has two elongate sides and two ends and a toe board secured adjacent to each of said sides and ends extending along the length thereof.

* * * * *